US007607178B2

(12) United States Patent
DeBlasis

(10) Patent No.: US 7,607,178 B2
(45) Date of Patent: Oct. 27, 2009

(54) GOALKEEPER'S GLOVE WITH PROTECTIVE FINGERTIP EXTENSION

(75) Inventor: Thomas DeBlasis, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 11/555,208

(22) Filed: Oct. 31, 2006

(65) Prior Publication Data

US 2008/0109935 A1 May 15, 2008

(51) Int. Cl.
*A41D 13/08* (2006.01)

(52) U.S. Cl. ..... 2/21; 2/160; 2/161.1

(58) Field of Classification Search ..... 2/16, 2/21, 159, 160, 161.1, 161.2, 161.3, 161.4, 2/161.6, 163, 20; 473/1, 505, 516, 518, 520; 294/25; 15/227

See application file for complete search history.

(56) References Cited

U.S. PATENT DOCUMENTS 683,869 A 10/1901 Weichert
1,005,511 A 10/1911 Carson
1,074,351 A 9/1913 Carson
1,684,076 A * 9/1928 Smith ..... 602/22
2,637,850 A * 5/1953 Watermann ..... 2/21
3,386,104 A * 6/1968 Casey ..... 2/16
3,593,803 A 7/1971 Ibach
4,766,612 A * 8/1988 Patton, Sr. ..... 2/16
4,796,306 A 1/1989 Mitchell
4,847,918 A 7/1989 Sturm
4,867,246 A 9/1989 Kiger
5,004,231 A 4/1991 Alread
5,644,796 A 7/1997 Laughlin
5,661,853 A 9/1997 Wilmot
5,685,014 A 11/1997 Dapsalmon
5,752,279 A * 5/1998 Hochmuth ..... 2/161.1
5,774,897 A 7/1998 Hochmuth
5,881,385 A * 3/1999 Hochmuth ..... 2/161.1
5,881,388 A * 3/1999 Pratt ..... 2/163
5,946,720 A * 9/1999 Sauriol ..... 2/16
5,963,985 A 10/1999 Behr et al.
5,970,521 A * 10/1999 Rabbeth ..... 2/161.1
5,974,588 A 11/1999 Furman
6,742,190 B1 * 6/2004 Tobelmann ..... 2/159
2006/0185058 A1 8/2006 McGough

FOREIGN PATENT DOCUMENTS

DE 19856310 6/2000
GB 2113977 8/1983

* cited by examiner

*Primary Examiner*—Gary L Welch
*Assistant Examiner*—Sally Colson Cline
(74) *Attorney, Agent, or Firm*—Plumsea Law Group, LLC

(57) ABSTRACT

A goalkeeper's glove with a glove body portion and glove fingers attached to and in communication with the body portion for enveloping a wearer's hand includes an open arch extension with attachment legs on at least one glove finger to protect the finger from jamming injuries and to extend the reach of the wearer. The arch of the extension creates an air gap between the extension tip and the tip of the finger that acts as a crumple zone in absorbing and dissipating the energy of the impact away from the fingertip to prevent a jamming injury. The arch construction ensures that the energy from the impact will be directed along the attachment legs along the length of the finger instead of the fingertip.

20 Claims, 6 Drawing Sheets

GOALKEEPER'S GLOVE WITH PROTECTIVE FINGERTIP EXTENSION

BACKGROUND OF THE INVENTION

1. Field of the Invention

The present invention relates to the field of athletic gloves, and more particularly to a goalkeeper's glove with protective fingertip extension elements to both protect against jamming injuries to the fingers and to extend the reach of the wearer.

2. Background of the Invention

As the only soccer players who are allowed to use their hands during play, goalkeepers are selective about the gloves they wear to help them get a secure grip on the ball and to provide a measure of protection for their hands. Besides catching the ball in the air or stopping the ball on the ground, goalkeepers frequently punch or tip the ball away from the goal or out of bounds over the goal to make saves since giving an opponent a corner kick opportunity is much better than giving up a point. Also, the goalkeeper frequently collides with an opponent or must put himself/herself in harm's way in either pursuit of the ball or in protecting the ball during play. The goalkeeper's hands are vulnerable to injury due to all of the possible impacts with the ball, the ground, the goal itself or other players.

Injuries to the fingers often receive little attention, even though they are relatively common and painful. Given that the two hands contain a total of some 30 finger bones connected at the joints by ligaments, in addition to all of the tendons connecting these bones to the muscles in the hands, it is not surprising that fingers are often the locus of sports injuries. A common injury is a jammed finger which refers to a wide array of strain, sprain or dislocation injuries of the finger generally due to a blow to the end of the finger. One type of jamming injury is referred to as mallet finger in which the tendon that straightens the tip of the finger is injured. Without prompt medical attention, permanent loss of the ability to straighten the finger is possible. In strain injuries, the ligaments are over-stretched causing pain and swelling. Sprain injuries result from partial tearing and disruption of the ligaments. In another typical jamming injury, a finger joint is compressed with the adjacent bones forced together with a twisting of the joint as well. The compression and torquing can often lead to dislocation of the joint. Severe dislocation can also result in complete ligament tears. These types of injuries to the fingers and hands are painful and frequently require long recovery times.

In addition to hand protection, it is advantageous for a goalkeeper's glove to extend the reach of the goalkeeper. This is true in any playing situation in which the goalkeeper is reaching to make a save or to punch or tip a ball away from the goal.

Prior goalkeeper's gloves have provided enhanced protection for the hands primarily against wear and abrasion. U.S. Pat. No. 5,752,279 to Hochmuth discloses a goalkeeper's glove with finger tip caps provided at the ends of the glove's finger. Each cap comprises hat-shaped elastically compressible padding formed of porous rubber material or sponge rubber material that is in contact with and grasps the keeper's finger tip. Prior goalkeeper's gloves have addressed enlarging the surface area of the hand. For example, a prior goalkeeper's glove illustrated in DE 19856310 to Scheuermann provides a larger handprint by use of lateral extensions around the fingers.

Reinforcing the glove fingers from excessive wear has been the focus of work gloves as well. U.S. Pat. No. 1,074,351 to Carson discloses a work glove for handling sacks of grain or cement, and barrels and boxes in which wear occurs most heavily on the rear portion of the fingers and over the fingernails. To combat the added wear in this area Carson provides a leather hood over the tip and top of each finger of the glove.

U.S. Patent Publication No. 2006/0185058 to McGough discloses an American football quarterback glove that is designed to protect the hand from blows against the helmet of a defender. McGough discloses hollow fingertip inserts that are molded from semi-rigid rubber-like material and which fully surround the tips of the fingers like sewing thimbles while lengthening the fingers slightly. The inserts are contoured to conform to the rounded shape of the football so that the fingertips make complete contact with the surface.

Given the frequency of hand injuries experienced by goalkeepers, and the attendant discomfort and recovery time, there is a need to better protect goalkeepers' hands while ensuring that there is no performance disadvantage for doing so.

SUMMARY

The goalkeeper's glove of the present invention provides enhanced protection against jamming injuries while also extending the reach of the player. The glove defines a palmar surface, a dorsal surface, a lateral side and a medial side for enveloping the wearer's hand. The glove has a body portion for containing the palm area of the wearer, and glove fingers for receiving the wearer's fingers. At the tip of at least one of the glove fingers, an extension with an open arch construction is attached to create an air gap between the tip of the extension and the tip of the glove finger. The arch has attachment legs extending from the apex, and these legs are attached to the glove finger by adhesive or stitching or both. A secondary arch spaced from the top arch spans the attachment legs and defines that air gap. Open arch construction refers to the generally open air gap defined between the attachment legs and the tip of the arch. It is possible that ribs or other types of reinforcing or energy dissipating structures could span the air gap and still maintain the open arch construction as used herein.

When a goalkeeper's hands come into contact with the ball, another player, the ground or the goal so as to cause a collision with the fingertips, the air gap acts as a crumple zone in absorbing and dissipating the energy of the impact away from the fingertip to prevent a jamming injury. The arch construction ensures that the energy from the impact will be directed along the attachment legs along the length of the finger instead of the fingertip.

The open arch extension also extends the reach of the goalkeeper to increase the likelihood of making a save by stopping the ball or hitting the ball away from the goal.

The extension can be attached to the glove finger in a number of alternative ways. First, the extension may be attached to the outside of the glove so it is visible, or may be covered by an outer layer. Second, the attachment legs could be attached along the lateral and medial sides of the glove finger, or could be attached along the palmar and dorsal surfaces of the glove finger.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Figure 1:
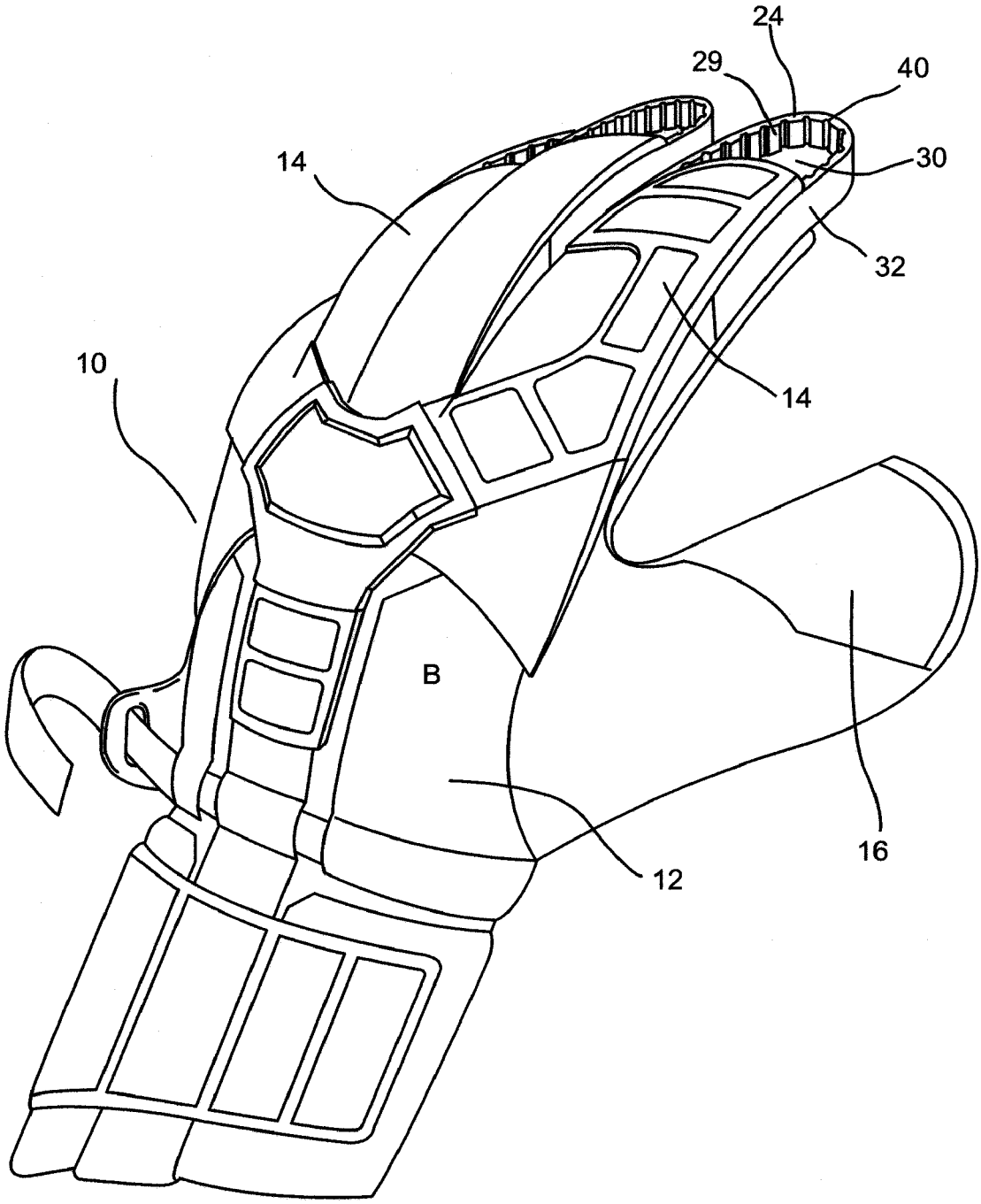
FIG. 1 is perspective view of a goalkeeper's glove with protective fingertip extensions mounted in a side-to-side orientation in accordance with the present invention.
Figure 2:
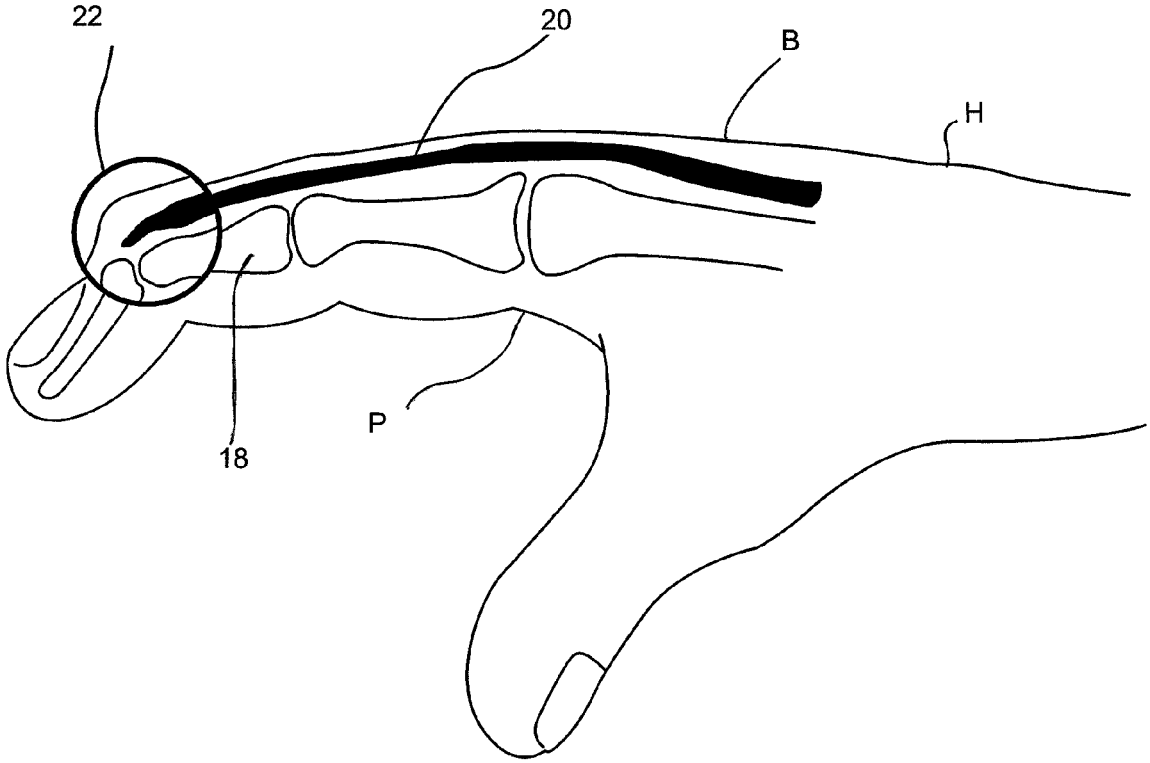
FIG. 2 is a schematic diagram of a hand illustrating a jamming injury to a finger.

Goalkeeper glove 10, FIG. 1, comprises a glove body portion 12 for enveloping the palm of the hand of a wearer, four glove fingers 14 for receiving the fingers, and a glove thumb 16 for receiving the thumb. The glove body defines a lateral side corresponding to fifth finger side of the hand, and a medial side corresponding to the thumb side of the hand. Glove 10 is padded and reinforced in appropriate areas to protect the hand of the wearer. FIG. 2 is a schematic illustration of a jammed finger injury to hand H. For ease of reference for both a hand and a glove, the dorsal surface, the back of the hand is labeled B and the palmar surface, the palm is labeled P. The injury shown in FIG. 2 is a mallet finger injury in which bones 18 in the finger were compressed together due to a blow to the fingertip resulting in an injury to tendons 20 at joint 22. These tendons normally straighten the finger at that joint, but when injured are unable to do so. This is one of the types of jamming injuries common to soccer goalkeepers that glove 10 is constructed to prevent. Attached to the tip of each finger 14 of glove 10 is an extension 24 that extends beyond the fingertips of the wearer. For convenient reference to the drawings, this description will refer to the glove and extension in the orientations shown in FIGS. 1 and 3, for example, as having an upper portion that corresponds to the tips of the fingers and the glove body portion being below the fingers. It will be understood that these directional adjectives will change with a change in orientation of the glove.

Figure 3:
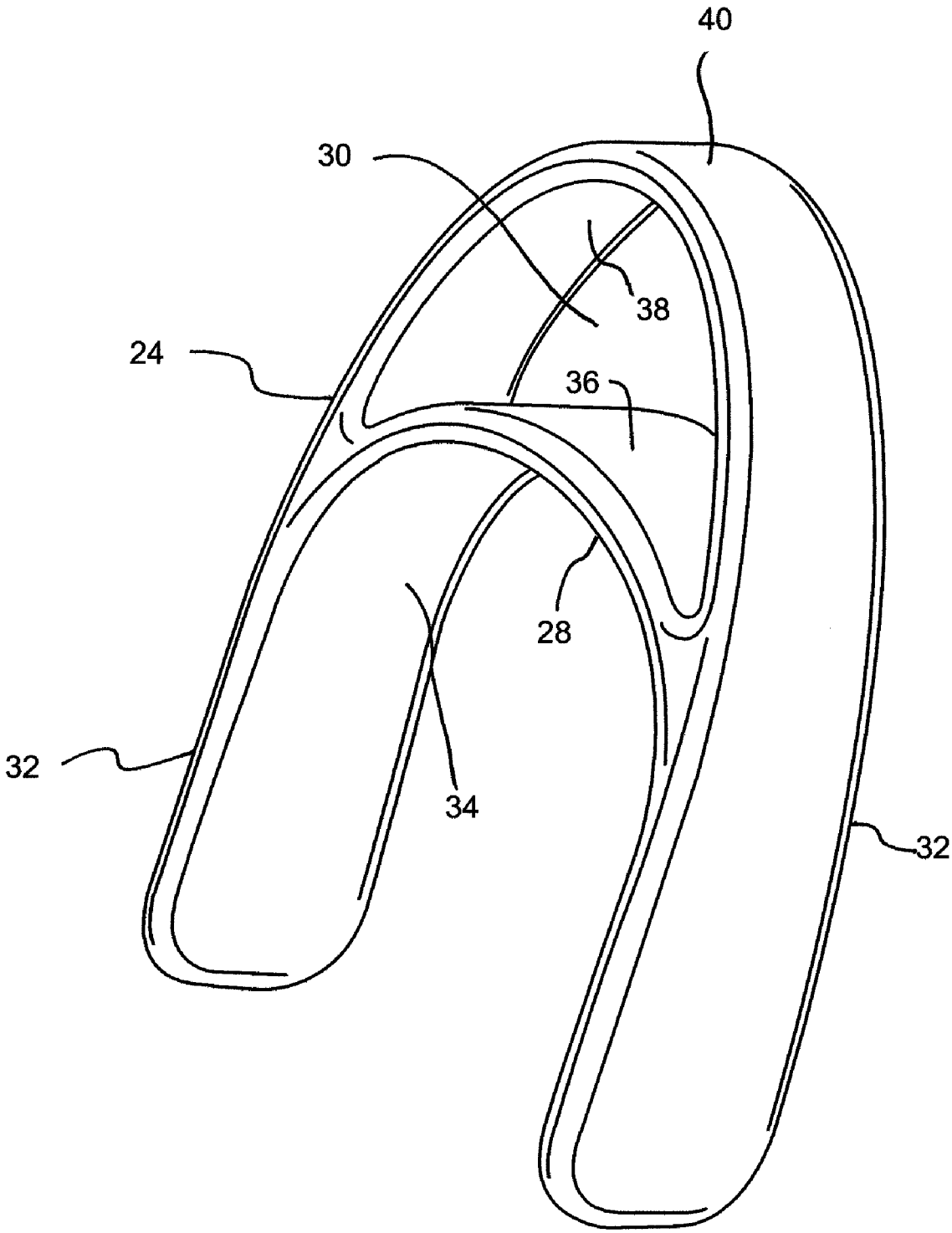
FIG. 3 a perspective view of a fingertip extension shown in isolation.

A detailed view of extension 24 in isolation is provided in FIG. 3. Extension 24 has a top arch 26 and a lower bridging arch 28 creating an air gap 30 therebetween. Attachment legs 32 extend downward from these arches and are attached to the sides of glove fingers 14. As seen in FIG. 1, lower bridging arch 28 has a concave side 34 that is attached to the tip of glove finger 14 and approximates the shape of that tip. Arches 26 and 28 are curved in the same direction. That is, convex surface 36 of lower arch 28 faces concave surface 38 of top arch 26 across air gap 30, and convex surface 40 of top arch 26 forms the outer or top surface of extension 24. Top arch 26 has a shape that approximates a catenaric or parabolic arch to direct compressive forces on convex surface 40 outward and downward through legs 32. The creation of the air gap results from the use of this open arch construction.

Open arch construction refers to the generally open air gap defined between the attachment legs and the tip of the arch. It is possible that some structural elements could span the air gap and while still maintaining the open arch construction as the term is used herein. For example, one or more reinforcing ribs could be added across the air gap; or one or more energy dissipating structures could span the air gap, with the arch area being largely open to act as the crumple zone.

Glove body 12 and glove fingers 14 are made of a combination of pliable materials such as leather, latex, vinyl, or cloth. In contrast, extension 24 is preferably made of a semi-rigid plastic material, and protects the hand of the wearer from jamming injuries by directing a blow away from the tip of the finger. When the tip of extension 24 experiences a compressive impact, the double arch structure forming the air gap provides a crumple-zone that absorbs and distributes the energy from the impact to the more rigid material of the extension rather than directly to the finger tip through the pliable glove material. It may be advantageous to design extension 24 to deform slightly upon impact to absorb a relatively large share of the impact energy. In addition, the double arch structure of extension 24 also directs impact energy down to legs 32 so as to dissipate the energy along the sides of the finger. In this manner, jamming injuries to the fingertips are lessened or prevented altogether.

A feature shown in FIG. 1 are crenulations 29 along the interior surface of extension 24. Crenulations 29 may be provided to maintain the curvature of arched extension 24, or to facilitate the formation of that curvature depending on the manufacturing process for making extension 24.

Figure 4:
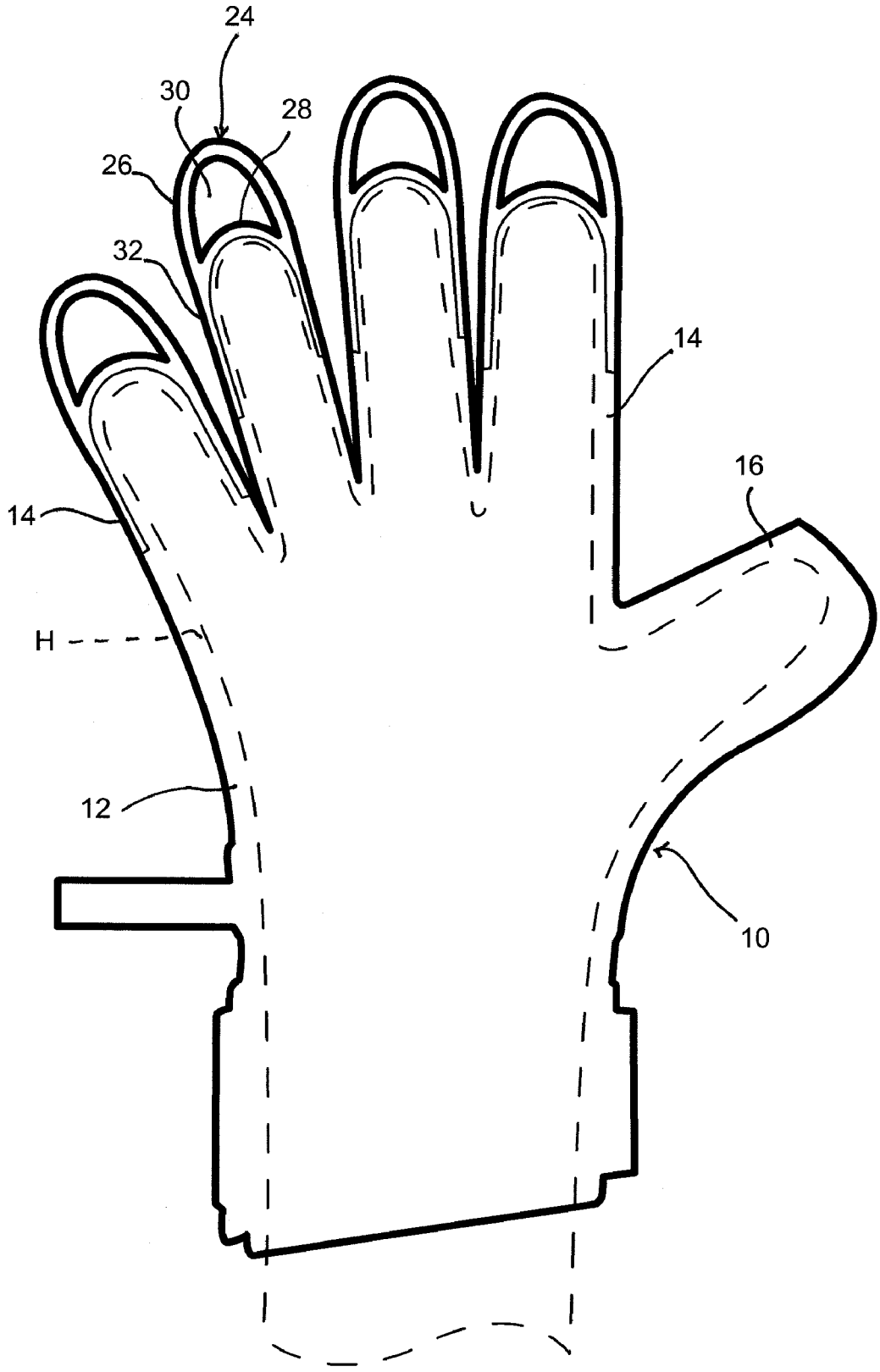
FIG. 4 is a schematic top outline view of the glove of FIG. 1.

In addition to injury protection, extensions 24 also provide a performance advantage for goalkeepers. FIG. 4 illustrates a schematic top outline view of glove 10 in which a hand H is shown in phantom lines to demonstrate how the extensions lengthen the reach of each of the fingers. For clarity, reference numerals for the extension are provided only on the ring finger of the glove, with the understanding that each of the extensions have corresponding parts. The extensions are mounted to the exterior of the glove as also seen in FIG. 1. The extension illustrated on the index finger in FIG. 1 is exemplary of extensions on the other fingers and is shown to have a dorsal edge corresponding to dorsal surface B of the glove, and a palmar edge corresponding to the palmar surface P of the glove. In addition, it can be seen that the width or thickness of the extension between the dorsal and palmar edges is less than the thickness of the finger of the glove as the attachment legs are attached between the dorsal and palmar surfaces of the glove finger. Comparing the outline of the glove and the extensions 24, it can be seen that extensions 24 lengthen each finger to which they are mounted by a distance corresponding to air gap 30. As described in the Background section, goalkeepers frequently reach out to make saves or punch or tip the ball away from the goal, and increasing the lengths of the fingers can be advantageous in many playing situations.

Figure 5:
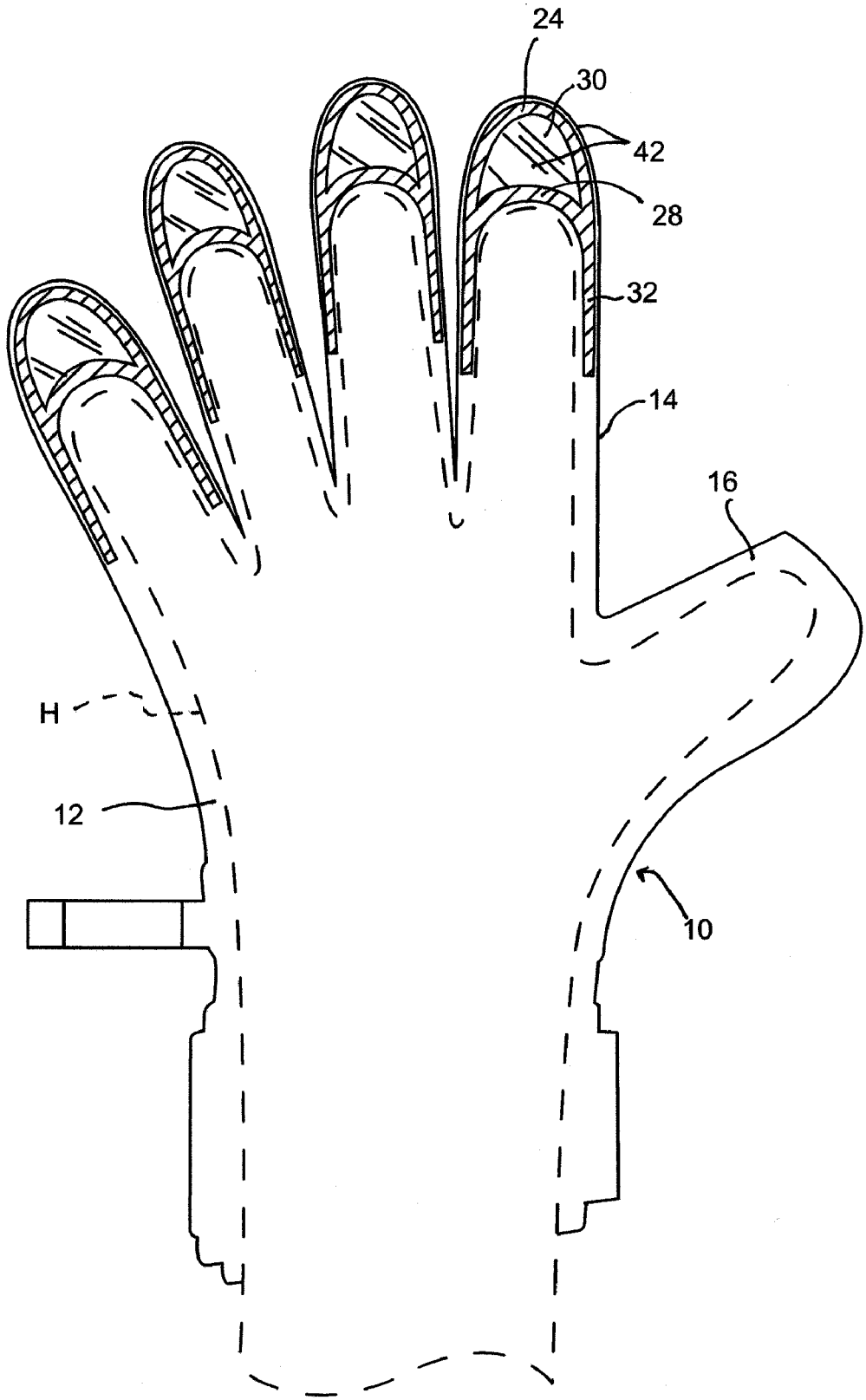
FIG. 5 is a view similar to FIG. 4, but showing a schematic sectional view of an alternative embodiment of the glove in which the fingertip extensions are disposed inside the glove.

Glove 10 has heretofore been described with extensions 24 mounted to exterior surface of glove fingers 14. However, extension 24 will function as a crumple zone for compressive impact regardless of whether the extension is attached to the outside of the glove or the inside of the glove. An alternative embodiment of the glove is shown schematically in sectional view FIG. 5 in which extensions 24 are mounted to an interior surface of the glove fingers and a layer of material 42 is applied over the extensions. In the sectional view, FIG. 5, outer covering 42 is shown applied to the extensions themselves, and also underneath the extensions such that outer covering 42 is visible though air gap 30. Also for clarity, reference numerals for the extension are provided only on the index finger of the glove, with the understanding that each of the extensions have corresponding parts. In the finished glove, extensions 24 will not be visible as they are covered, but will function in exactly the same way to provide an air gap crumple zone in the event of a blow to the fingertips. Outer covering 42 may be of any appropriate material such as latex.

Figure 6:
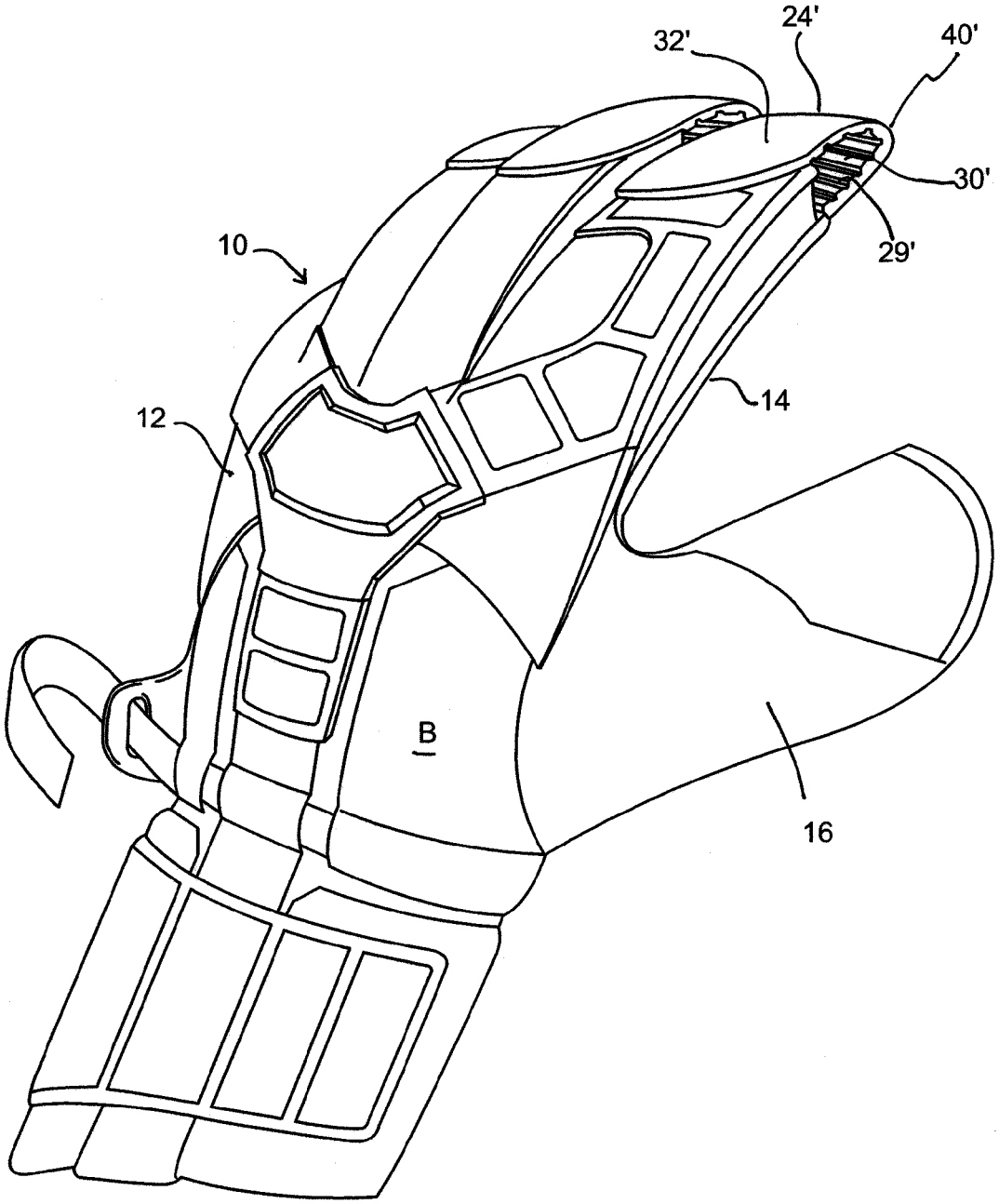
FIG. 6 is a perspective view of an alternative embodiment of the goalkeeper's glove with protective fingertip extensions mounted in a palm-to-back orientation.

The embodiments of the glove shown in FIGS. 1 and 3-5 all show the extensions with attachment legs 32 mounted to the sides of glove fingers 14. That is, viewing the back of the hand B, an end view of the double arch shape is visible as in FIG. 4-5. The principles of the invention are also applicable to another modification of the extensions. For example, FIG. 6 illustrates an alternative embodiment of glove in which extensions 24' are designed such that attachment legs 32' are mounted to the back and palm sides of the glove fingers. That is, viewing the back of hand B, on each finger with an extension 24' an attachment leg 32' would be visible. The principles apply to this embodiment as well, as extension 24' is structurally similar in having an open arch creating an air gap between the top arch and the fingertip of the glove finger between the attachment legs. A secondary arch spaced from the top arch creates a double arch structure that acts as a crumple zone when the fingertips are impacted. While FIG. 6 illustrates an exposed extension 24', it is also with the purview of the invention to enclose extension 24' underneath an outer covering layer such as the embodiment of FIG. 5.

Extensions 24' shown in the glove in FIG. 6 also include the interior surface crenulations 29' to facilitate or maintain the curvature of the arch. Applicant also contemplates that an interior features such as the crenulations 29' could be employed to provide some measure of adjustability to extensions 24'. One way that this may be achieved is to fix one attachment leg 32' to the glove finger, and leaving the opposing attachment leg to be adjustably attached to the glove finger relying on crenulations 29' for articulation of the arch to provide length adjustment of the extension 24'. Length adjustment of the extensions is contemplated as ranging from being fully retracted so that the arch bears against the glove finger tip, to fully extended which represents the maximum length of the extensions. Both the side-to-side mounted extension as shown in FIG. 1 and the palm-to-back mounted extension shown in FIG. 6 may include such adjustability.

Employing the double arch structure with the air gap not only provides the structural advantages as discussed, but also provides protection and finger extension with a minimum of added bulk and mass. The double arch extensions act as a bone structure or exoskeleton to the glove fingers to provide structural protection without adding significant weight or cumbersome thimble like caps.

To further reduce weight, it may be possible to use a single arch structure to achieve the same results as long as an air gap is created between the tip of the extension and the glove finger. For example, the glove finger could be modified or reinforced at the tip and along the areas where the attachment legs of the extension are attached. A single arch construction would rely more on the attachment of legs to the glove finger to ensure that energy from an impact is absorbed and/or dissipated away from the tip of the wearer's finger.

The extensions could be made of any suitable semi-rigid plastic, nylon or fiberglass material. For example, the extension could injection molded of a suitable thermoplastic polyurethane elastomer (TPU). The extension could also be formed from flat sheet material. For some sizes of gloves, it may be advantageous to form the extensions so that attachment legs 32 are biased toward each other, and fit onto a glove finger with a spring action. Alternatively, it may be advantageous in some applications or attachment situations to form the extensions so that attachment legs are biased apart slightly. Regardless of whether the attachment legs are biased or not, the extensions are preferably secured to the glove fingers by adhesive or stitching or both.

While the embodiments illustrated show extensions on each of the four fingers and not on the thumb, it is within the purview of the invention to employ an extension on the thumb as well. For purposes of this application, the term finger can refer to the thumb. Some sports injuries studies have shown that the middle finger is the most likely to suffer a jamming injury, and it is possible that the goalkeeper's glove of the present invention could incorporate an extension on only one finger. Depending on the construction of the glove, extensions could be used on one finger, or one any combination of fingers including all five.

While various embodiments of the invention have been described, it will be apparent to those of ordinary skill in the art that may more embodiments and implementations are possible that are within the scope of the invention.

What is claimed is:

1. A goalkeeper's glove defining a palmar surface, a dorsal surface, a lateral side and a medial side for enveloping the hand of a wearer, said glove comprising:

a glove body for containing the wearer's palm;

a glove finger for receiving a finger of a wearer, said glove finger being attached to and in communication with said glove body at one end and having a closed tip at the other end; and an extension attached proximate said closed tip of said glove finger, said extension having an open arch with attachment legs extending therefrom, one said attachment leg extending integrally and contiguously from one side of said open arch and attached to said glove finger, and another said attachment leg extending integrally and contiguously from another side of said open arch and attached to said glove finger, said extension thus attached to said glove finger providing an air gap between said closed tip and said arch.

2. The glove of claim 1, wherein said attachment legs are attached along the lateral and medial sides of said glove finger.

3. The glove of claim 2, wherein said extension is covered by an outer layer.

4. The glove of claim 1, wherein said attachment legs are attached along the palmar and dorsal surfaces of said glove finger.

5. The glove of claim 4, wherein said extension is covered by an outer layer.

6. The glove of claim 1, wherein said extension comprises a secondary arch spaced from said open arch and spanning said attachment legs so as to define said air gap therebetween.

7. The glove of claim 6, wherein said attachment legs are attached along the lateral and medial sides of said glove finger and said secondary arch is attached to said closed tip.

8. The glove of claim 7, wherein said extension is covered by an outer layer.

9. The glove of claim 6, wherein said attachment legs are attached along the palmar and dorsal surfaces of said glove finger and said secondary arch is attached to said closed tip.

10. The glove of claim 9, wherein said extension is covered by an outer layer.

11. A goalkeeper's glove defining a palmar surface, a dorsal surface, a lateral side and a medial side for enveloping the hand of a wearer, said glove comprising:

a glove body for containing the wearer's palm;

a plurality of glove fingers each for receiving a finger of a wearer, said glove fingers being attached to and in communication with said glove body at one end and having a closed tip at the other end; and a double arch extension attached to at least one of said glove fingers proximate said closed tip, said extension having a top arch with attachment legs extending therefrom, one said attachment leg extending integrally and contiguously from one side of said top arch and attached to said glove finger, and another said attachment leg extending integrally and contiguously from another side of said to arch and attached to said glove finger, and a secondary arch spanning said attachment legs to form an air gap between said top arch and said secondary arch, concave side of the secondary arch abutting against said closed tip of the glove finger.

12. The glove of claim 11, wherein said attachment legs are attached along the lateral and medial sides of said glove finger.

13. The glove of claim 12, wherein said extension is covered by an outer layer.

14. The glove of claim 11, wherein said attachment legs are attached along the palmar and dorsal surfaces of said glove finger.

15. The glove of claim 14, wherein said extension is covered by an outer layer.

16. The glove of claim 11, wherein said extension is provided on each of said glove fingers.

17. A glove comprising:

A glove body portion defining a palmar surface and a dorsal surface;

a finger portion extending from the glove body portion, the finger portion also defining a dorsal surface and a palmar surface connected to one another and defining a thickness therebetween; and an extension provided proximate a closed tip portion of the finger portion, the extension comprising attachment legs attached to the finger portion, one said attachment leg extending integrally and contiguously from one side of said extension, and another said attachment leg extending integrally and contiguously from another side of said extension, and an arch having palmar edge and a dorsal edge and defining a width therebetween, the width being less than the thickness between the palmar surface and dorsal surface of the finger portion.

18. The glove of claim 17, wherein the extension comprises a secondary arch spaced from the arch and spanning the attachment legs so as to define an air gap therebetween.

19. The glove of claim 18, wherein the attachment legs are attached along the lateral and medial sides of the finger portion and the secondary arch is attached to the closed tip.

20. The glove of claim 19, wherein the extension is covered by an outer layer.

* * * * *